US005131658A

United States Patent [19]

Grenon

[11] Patent Number: 5,131,658

[45] Date of Patent: Jul. 21, 1992

[54] MULTI-PURPOSE PUTTING GAME

[76] Inventor: Origene J. Grenon, 182 Killdeer Rd., Webster, Mass. 01570

[21] Appl. No.: 780,038

[22] Filed: Oct. 21, 1991

[51] Int. Cl.[5] ..... A63B 69/36

[52] U.S. Cl. ..... 273/180; 273/176 F

[58] Field of Search ..... 273/127 R, 185 R, 178 R, 273/180, 176 F, 176 FA, 176 FB

[56] References Cited

U.S. PATENT DOCUMENTS

| | | | |
|---|---|---|---|
| 1,063,119 | 5/1913 | Clifford | 273/180 X |
| 1,874,873 | 8/1932 | Boye | 273/180 |
| 2,081,511 | 5/1937 | Smith | 273/180 |
| 2,121,270 | 6/1938 | Streich | 273/180 |
| 2,626,808 | 1/1953 | Abrams | 273/127 R |
| 2,810,580 | 10/1957 | Johnson | 273/180 |
| 3,097,849 | 7/1963 | Rice | 273/180 |
| 3,434,720 | 3/1969 | Hall | 273/180 |
| 3,876,210 | 4/1975 | Brandell | 273/180 |
| 4,098,507 | 7/1978 | Hudon | 273/34 B X |
| 4,203,604 | 5/1980 | Grange | 273/180 |
| 4,691,923 | 9/1987 | Schwartz | 273/180 |

FOREIGN PATENT DOCUMENTS

| | | | |
|---|---|---|---|
| 375478 | 6/1932 | United Kingdom | 273/180 |

*Primary Examiner*—George J. Marlo
*Attorney, Agent, or Firm*—Edward M. Livingston

[57] ABSTRACT

A putting game-playing board apparatus having a mainframe (1) with inclined borders (2) surrounding a central section (3) which contains holes (4) for receiving and retaining a ball (8) hit up and over the inclined borders (2) by a player (7) using a golf putter (9). The holes (4) contain one or more concentric tiers (5) to make it more difficult and challenging to hit a ball (8) into a particular hole. The central portion (3) of the main frame may be recessed to receive different interchangeable playing inserts (17) so that a multitude of different games can be played using the same apparatus. This apparatus is portable and may be used indoors or outdoors on any substantially planar surface.

9 Claims, 2 Drawing Sheets

MULTI-PURPOSE PUTTING GAME

BACKGROUND OF THE INVENTION

This invention relates to putting game devices, and more particularly a game board device that can be used to practice golf putting with playing a multitude of games.

In order to improve one's golf-putting skills, it is necessary for one to practice putting on a regular basis so that one can improve eye and hand coordination. Although a person gets practice putting on a putting green or during actual play at a golf course, it is generally too time-consuming, especially for business people, to go to a golf course just to practice putting. For such people, it is necessary to practice putting in the office or at home. Unfortunately, practicing putting itself in the home or office can quickly develop boredom. Thus, there is a need for a putting game device that will eliminate such boredom and still be convenient for a person to practice putting.

There are numerous devices on the market and in the prior patented art that can be used to practice golf putting, but none of the devices is the same as the present invention nor does any provide the same level of skill and entertainment as the present invention.

The following U.S. Patents are relevant:

| U.S. Pat. No. | Name | Issue Date |
|---|---|---|
| 3,097,849 | Rice | 16 JUL 63 |
| 3,876,210 | Brandell | 08 APR 75 |
| 4,691,923 | Schwartz | 08 SEP 87 |
| 4,203,604 | La Grange | 20 MAY 80 |
| 2,081,511 | Smith | 25 MAY 37 |
| 1,874,873 | Boye | 30 AUG 32 |
| 3,434,720 | Hall | 25 MAR 69 |
| 2,810,580 | Johnson | 22 OCT 57 |
| 2,121,270 | Streich | 21 JUN 38 |
| 1,063,119 | Clifford | 27 MAY 13 |

The Rice patent teaches a golf-putting game device with multiple cups mounted in a square mat surrounded by beveled edges. Although it is somewhat similar in structure to the present invention, the Rice device does not have tiered, concentric cups, nor does it provide for different, insertable mats for playing a multitude of sporting games.

The Brandell patent teaches a golf-putting game device having a multiple-holed target with a raised surface providing varying degrees of difficulty. It, too, does not have the features of the present invention.

The Schwartz patent teaches a triangular, chute-like device with inclined surface for varying degrees of difficulty.

The La Grange patent teaches a golf mat with spaced holes utilizing a card holding container with various golf situations and rules chosen by the numbers below the holes.

The Smith patent teaches a golf-putting game with beveled edges, a central hole and ribbed portions.

The Boye patent shows a golf-putting game device which is semi-circular, has an incline in the front and holes with different numbers associated therewith.

The Hall device has an inclined entrance with holes around the outside with various numbers.

The Johnson patent teaches a triangular-shaped golf-putting device with an incline around the sides and holes on the top surface.

The Streich patent teaches a circular golf-putting device with inclines and a central, indented surface with holes.

Finally, the Clifford patent teaches a golf-putting device which is rectangular in shape with inclines on two sides and holes on top with mesh to receive balls.

Although there are many golf-putting game devices, none is like the present invention. The present invention has tiered concentric holes to provide a more challenging putting game. Furthermore, this invention is not limited just to golfing, because of various mats which are insertable in the invention allow a multitude of sports to be played.

SUMMARY OF THE INVENTION

The primary object of the present invention is to provide a putting game device which can be used to improve putting skills.

Another object of the present invention is to provide a putting-game device that reduces the boredom which normally develops while continuing to practice putting skills.

A further object of the present invention is to provide a putting-game device that can be used to play a multitude of sports-related games.

An even further object of the present invention is to provide a putting-game device that is fun and entertaining.

An additional object of the present invention is to provide such a device that is convenient to use in almost any location, be it indoors or outdoors, at the office or at home.

The present invention accomplishes the above and other objects by providing a game playing board apparatus which has a main frame which rests on a substantially planar surface, said frame having an outer border which slopes upwardly from the perimeter of the frame to the perimeter of a central portion of the main frame. The central portion contains holes for receiving balls which are hit by a golf putter up and over the sloping border. The base frame may take any shape, whether it be rectangular, circular, triangular, or octagonal. The central portion is preferably recessed so that various inserts may be placed therein, depending on which game is being played. Each hole has concentric, tiered portions so that the balls will not go into a hole easily, but will be diverted unless the ball is accurately hit toward the hole. Each insert contains various labels depending on the sport being played. When playing golf, for instance, the labels might include "BIRDIE", "PAR", "ACE" and "BOGIE"; whereas, in baseball, the labels might include "SINGLE", "DOUBLE", "TRIPLE" and "HOME RUN". Although the holes may have sufficient depth to allow the bottom of the holes to rest on the surface, thereby providing support for the apparatus, the apparatus may be further supported by ribs running crosswise between the holes on the bottom side of the apparatus. Optionally, the rules of a particular game, such as tic-tac-toe, require holes to be covered or blocked, disk-like covers are provided to cover such selected holes.

BRIEF DESCRIPTION OF THE DRAWINGS

This invention is described by claims in relation to a description of preferred embodiments illustrated in the following drawings in which:

DESCRIPTION OF THE PREFERRED EMBODIMENTS

Figure 1:
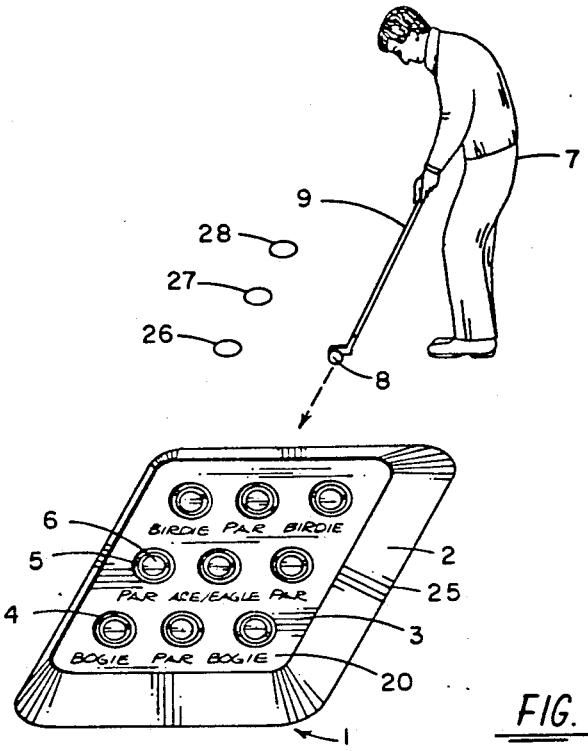
FIG. 1 is a perspective view of the game-board apparatus in actual playing conditions.
Figure 2:
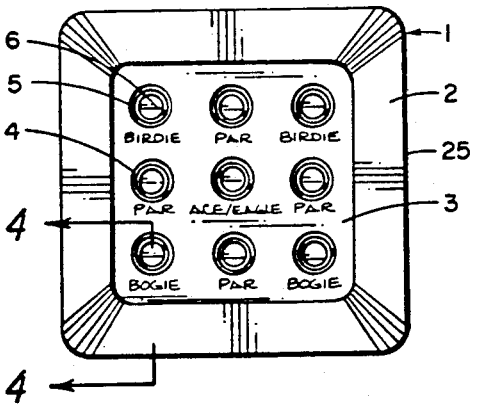
FIG. 2 is top view of the game-board apparatus.

Referring now to the drawings more particularly, FIGS. 1 and 2, the game-board mainframe 1 is comprised of an inclined border 2 which slopes upward from the perimeter 25 to a top central portion 3. The central portion 3 contains one or more holes 4 for receiving a ball, such as a golf ball 8 which is hit by a player 7 using a golfing putter 9. Each hole 4 further contains a series of concentric tiered circles 5 with a central hole 6 in which the golf ball 8 ultimately rests. Various tee markers, 26, 27 and 28 may be placed different distances from the game board apparatus 1. The par from the various tee markers may differ. For instance, tee marker 26 may be represent the red tee on a regular golf course and may be placed three feet from the gameboard apparatus 1 and be a par three. Tee marker 27 may be a white tee marker placed four feet from the gameboard 1 and could be a par four. Finally, tee marker 28 could represent the blue tee markers and be placed five feet from the gameboard 1 and be a par five.

Figure 3:
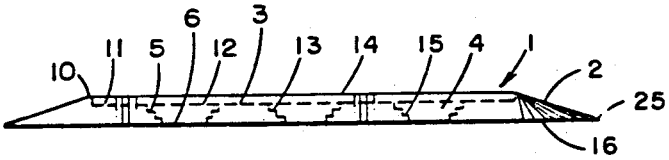
FIG. 3 is a side plan view of the game-board apparatus.

In the plan view of the game-board mainframe 1 shown in FIG. 3, the bottom edge 16 of the game board 1 rests on a floor or ground, depending on where the game-board apparatus 1 is used. The inclined border 2 is shown sloping upward and inward from the perimeter 25 to an edge 10 where it meets a recessed central portion 11. The recessed central portion is surrounded by a top wall 14 which is high enough so that it will keep a ball 8 in play once it is hit up the incline 2. Also, the central portion 11 is recessed sufficiently to allow an insert to be placed in the recessed central portion 11 and contained within the top walls 14 so that a variety of games may be played using the same game board apparatus. FIG. 3 further illustrates the concentric tiers 5 within each hole 4, showing a first concentric tier 13, second concentric tier 15, which lead to a bottom central hole 6. The concentric tiers 13 and 15 in each hole make the use of this game-board apparatus more challenging as the ball 8 may roll over, around and out of a hole 4 unless the ball 8 is moving very slowly or it is hit directly toward the hole 4.

Figure 4:
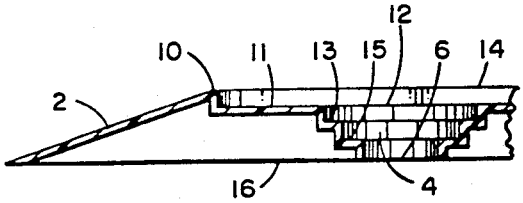
FIG. 4 is a cross-sectional view of the game board along lines 4—4 of FIG. 2.

The enlarged cross-sectional view in FIG. 4 shows more clearly the concentric tiers 13 and 15 in each hole 4. The other components of the game board apparatus previously discussed are also shown more clearly.

Figure 5:
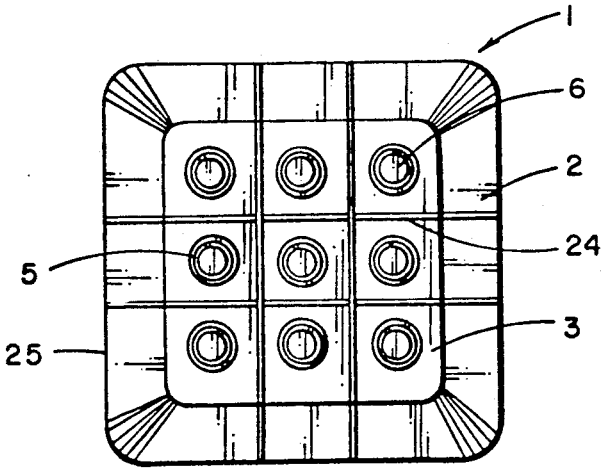
FIG. 5 is a bottom plan view of the game-board apparatus.

In FIG. 5, the bottom of the gameboard 1 is illustrated showing the components as they would appear from the bottom. It is important to note that support for the mainframe 1 is primarily the result of the game board 1 resting on the perimeter 25 and the bottoms of the central holes 6 which rest on the playing surface on which the mainframe 1 is placed, whether the playing surface be the floor or outside on the pavement or ground. The game board apparatus mainframe 1 may even be placed on a table top and the game played by rolling the ball by hand in lieu of putting. Although not necessary, further support for the mainframe 1 may be provided by the inclusion of support ribs 24 under the game-board apparatus 1.

Figure 6:
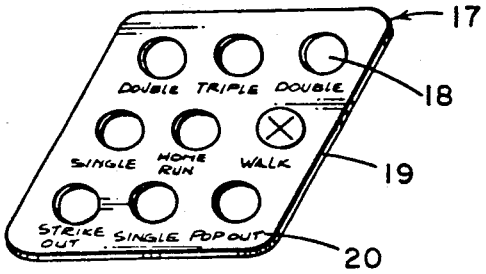
FIG. 6 is a perspective view of an insert for the game board for playing a baseball game.

FIG. 6 shows an insert 17 for the game-board apparatus, which may be placed in the recessed central portion 11 of the game-board mainframe 1. The use of such an insert enables a multitude of sporting-related games and other games, such as tic-tac-toe, to be played utilizing this game board apparatus. The insert 17 will contain holes 18 which match the location of holes 4 in the game-board mainframe 1. Furthermore, the insert 17 will have relatively thin sides 19 and could be made of plastic, cardboard or other lightweight material. Each game-board insert 17 would contain various markings or legends 20 on it varying with the particular game to be played. For instance, the game board shown in FIG. 6 is for baseball, and may contain various markings 20 such as "HOME RUN", "DOUBLE", "SINGLE", "TRIPLE", "GROUND OUT", "STRIKE OUT", "FOUL" and "POP OUT".

Figure 7:
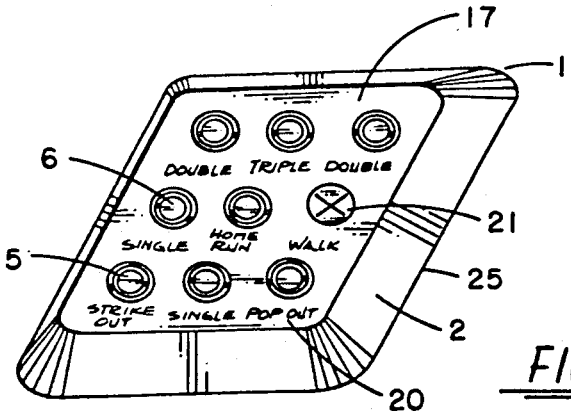
FIG. 7 is a perspective view of an insert in the game board with a disk-like hole cover in place.
Figure 8:
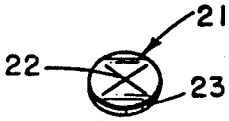
FIG. 8 is a perspective view of a hole cover by itself.

When the insert 17 is inserted into the mainframe of the game-board apparatus 1 as shown in FIG. 7, the game is ready for play. Special disk-like hole covers 21 are provided so that when various games are played, such as baseball, after one player "hits" a single, this disk-like hole cover can be placed over the hole marked "SINGLE". As shown in FIG. 8, this disk-like hole cover 21 may contain a marking 22 such as an "x" or even another letter depending on the game to be played. These disk-like hole covers 21 would have an edge 23, having the same width as the edge 19 of the game-board insert 17, so that when the hole cover 21 is placed over a particular hole, it will not interfere with subsequent balls being hit onto the mainframe 1.

The mainframe of the game-board apparatus 1 itself may be made of injection molded plastic, wood or other rigid material. The game-board inserts 17, which may also be made of plastic, wood, cardboard, fiberboard or any rigid material, may be stamped with various markings depending on the game to be played.

In actual play or operation, the object of a game, for instance golf, would be to shoot the lowest possible score by putting the ball from a designated tee area toward and up and over the inclined border 2 onto the central portion 11 and into a hole 4. The game-board apparatus could be placed on a carpet in one's home allowing at least six feet in front and three feet on the other three sides. Various tee markers could be placed a desired distance from the front of the game-board apparatus for various tee markers. For instance, a white marker tee could be four feet, a blue marker tee for four and one-half, and a gold tee five feet. Then each player could putt from the appropriate marker using his or her favorite putter. If one putts a ball into a hole on one shot, he or she would be considered to have completed that hole and would mark a score card for that value based on the assigned par for that hole. However, should the first putt not go into the hole, that player should continue to play and putt again from where the ball lies. Various situations could be identified for where a ball is hit. For instance, if the shot is to the left, right or short of the game-board apparatus 1 the ball could be considered "in the water" and a stroke could be added to the score and one would have to hit over again from the tee. If the tee shot ended up more than three feet from the "green", that is, the game-board apparatus, or to either side or the back, the ball would be considered "out-of-bounds" and one would add a stroke and hit again three feet from the tee. The back of the playing board 1 could be considered the "rough", to the left would be the "sand" and to the right could be considered "in the woods". The location of the tees could be changed to vary play such as playing the "back nine" holes. Additionally, the game could be played by any number of players in rotation, each taking turns in hitting the balls.

The present invention as described in detail in its various embodiments and provides a game-playing apparatus that contains novel differences and advantages over prior putting games. Among those advantages are that the present invention provides a more challenging and exciting putting game because it requires more accuracy in putting the ball due to the use of concentric-tiered holes. Also, this game-board apparatus helps to reduce the boredom associated with practicing golf putting because it has a central recessed portion which enables the use of various game-board inserts to be placed in the game-board apparatus for playing a variety of games.

Although a few embodiments of the present invention have been described in detail hereinabove, other modifications and improvements to the present invention within the scope or equivalents of the claims are also covered by this invention.

Having thus described my invention, I claim the following:

1. A game-playing board apparatus comprising:

a main frame having an outer border which slopes upwardly from a perimeter of said mainframe;

a central portion of the main frame for receiving a ball which is directed up and over the sloping board;

a plurality of holes in the central portion of the mainframe for retaining said ball; and wherein each hole has one or more concentric tiered steps within each hole.

2. The game-playing board apparatus of claim 1 in which the central portion is recessed from a top of the border.

3. The game-playing board apparatus of clam 2 including a planar insert which can be placed in the recessed central portion.

4. The game-playing board apparatus of claim 3 wherein the planar insert contains a plurality of holes matching in the location of the holes in the central portion of the main frame.

5. The game-playing board apparatus of claim 4 wherein the insert contains markings below each hole, said markings which vary depending on a particular game being played.

6. The game-playing board apparatus of claim 1 wherein the main frame contains support ribs beneath the central portion running crosswise between the holes to provide further support for the central portion of the mainframe of the apparatus.

7. The game-playing board apparatus of claim 1, or 2 further comprising disk-like covers having the shape, size and thickness designed to fit into and cover selected holes in the central portion of the mainframe.

8. The game-playing board apparatus of claim 3, 4 or 5 further comprising disk-like covers having a shape, size and thickness designed to cover selected holes in the insert.

9. The game-playing board apparatus of claim 2 wherein a bottom of a center of each hole rests on a surface on which the main frame is placed in order to provide further support for the main frame of the game-playing board apparatus.

* * * * *